US009352449B1

(12) United States Patent
Winter

(10) Patent No.: US 9,352,449 B1
(45) Date of Patent: May 31, 2016

(54) SANDING BLOCK

(71) Applicant: Lynn A. Winter, Bloomington, MN (US)

(72) Inventor: Lynn A. Winter, Bloomington, MN (US)

( * ) Notice: Subject to any disclaimer, the term of this patent is extended or adjusted under 35 U.S.C. 154(b) by 0 days.

(21) Appl. No.: 14/544,390

(22) Filed: Dec. 31, 2014

(51) Int. Cl.
*B24D 15/00* (2006.01)
*B24D 15/02* (2006.01)

(52) U.S. Cl.
CPC ..... *B24D 15/023* (2013.01)

(58) Field of Classification Search
CPC ..... B24D 15/023; B24D 5/00; B24D 9/04
See application file for complete search history.

(56) References Cited

U.S. PATENT DOCUMENTS

| | | | | | |
|---|---|---|---|---|---|
| 1,599,906 | A | | 9/1926 | McKnight | |
| 2,103,320 | A | | 12/1937 | Corff | |
| 2,112,593 | A | * | 3/1938 | Campbell | B24D 15/023 15/231 |
| 2,396,418 | A | | 3/1946 | Grenzow | |
| 2,454,668 | A | * | 11/1948 | Nissenbaum | A47L 13/286 451/516 |
| 2,457,076 | A | | 12/1948 | Williams, Jr. et al. | |
| D152,607 | S | | 2/1949 | Gerlinger | |
| 2,527,089 | A | | 10/1950 | Adams | |
| 2,657,508 | A | | 11/1953 | Schubert | |
| 2,765,593 | A | | 10/1956 | Salmon et al. | |
| 3,089,294 | A | * | 5/1963 | Cowley | B24D 13/14 451/490 |
| 3,175,334 | A | | 3/1965 | Price et al. | |
| 4,221,084 | A | | 9/1980 | Frantzen | |
| 5,131,193 | A | * | 7/1992 | Demers | B24D 15/023 451/490 |
| 5,168,672 | A | | 12/1992 | Gregoire, Sr. | |
| D365,507 | S | | 12/1995 | Pope | |
| 5,522,763 | A | | 6/1996 | Regnier | |
| D377,305 | S | | 1/1997 | Bliss | |
| D392,868 | S | | 3/1998 | Ansalvish | |
| 5,863,243 | A | | 1/1999 | Ali | |
| D417,131 | S | | 11/1999 | Peters et al. | |
| 6,062,966 | A | | 5/2000 | Ali et al. | |
| 6,296,558 | B1 | | 10/2001 | Poole et al. | |
| D481,284 | S | | 10/2003 | Hoek | |
| 6,641,469 | B2 | | 11/2003 | Deshler | |
| 6,682,400 | B2 | | 1/2004 | Draper | |
| 7,144,300 | B1 | | 12/2006 | Cybulski et al. | |
| 7,186,174 | B1 | | 3/2007 | Arnold | |
| 8,007,349 | B2 | | 8/2011 | Turnbull | |
| 8,388,419 | B2 | | 3/2013 | Koenig, Jr. | |
| 8,870,629 | B2 | | 10/2014 | Comstock et al. | |
| 2002/0090902 | A1 | * | 7/2002 | Draper | B24D 15/023 451/552 |

* cited by examiner

*Primary Examiner* — Dung Van Nguyen

(57) ABSTRACT

A sanding tool for holding sandpaper or other abrasive sheet material. The tool consists of a base unit with a flat sanding surface and two outwardly sloping end walls, and a block unit with an arcuate sanding surface having outwardly sloping end walls that slope to a lesser degree than the slope of the base unit end walls. A strip of sandpaper is placed on either sanding surface, and the block unit is then firmly inserted into the base unit. As the block unit is pressed firmly into the base unit, the ends of the sandpaper strip are wedged securely between the sloped ends of the block unit and the sloped inner surfaces of the end walls of the base unit wherein the sloped ends of the block unit impinge on the sloped end walls of the base unit with the ends of the sandpaper strip compressed tightly therebetween.

15 Claims, 2 Drawing Sheets

SANDING BLOCK

This invention relates to a handheld sanding block for supporting sandpaper or other abrasive sheet material thereon and, more particularly, pertains to a multi-surface sanding block that securely holds the abrasive sheet in place during the sanding operation and also when not in use.

BACKGROUND OF THE INVENTION

Existing sanding blocks typically have only one sanding surface. Often, the block configuration is not conducive to holding the abrasive material, e.g. sandpaper, without slippage or sagging during the sanding operation. Some conventional sanding blocks employ adhesive or a locking mechanism to hold the sandpaper to the sanding block, increasing manufacturing cost and requiring more preparation or setup time.

Existing sandpaper blocks frequently have additional shortcomings. For Example, tensioning the abrasive sheet is required to preclude the sheet from wrinkling or slippage during use. With currently available sanding blocks, especially single-piece sanding blocks, it is often difficult to load the abrasive sheet and secure it tightly to the block. If the abrasive sheet is not tight, it can wrinkle or tear. Loose or torn sandpaper may cause uneven sanding or possible damage to the work surface. Typically, both ends of the abrasive sheet must be installed on the sanding block simultaneously, which can require considerable dexterity and practice.

Despite the development of a variety of motorized sanding devices, there has always remained a continuing need for handheld sanding blocks. Over the years, a wide variety of sanding blocks have arisen. For example, U.S. Pat. No. 2,765,593 issued to Salmon et al. discloses a SANDING BLOCK consisting of a single piece with slits at the ends to hold the ends of the sandpaper strip. The slits serve to divide the ends of the body into an upper portion and a lower portion. The upper portion is flexible and can be bent upwardly to insert the ends of the sandpaper strip. A combination of matching recesses and ridges within the slits are employed to further grip the ends of the sandpaper strip. This configuration requires that the user bend both the upper portions upwardly while inserting both ends of the sandpaper sheet tightly, and then immediately pressing the upward and lower portions together. The device relies on the combination of recesses and matching ridges, along with hand pressure, to hold the ends of the sandpaper sheet in place, but continuous hand pressure is required to maintain the upper and lower portions together to secure the sandpaper. Whenever the user discontinues the sanding operation and removes his hand, the upper and lower end portions can separate sufficiently to release the grip on the ends of the sandpaper. Another drawback is that a considerable length of the sandpaper sheet is utilized for gripping the ends of the sheet.

Another example of a sanding block having slits at each end to hold the sandpaper strip is U.S. Pat. No. 6,062,966 issued to Ali et al. that discloses a SANDING BLOCK wherein a flexible intermediate portion allows the end portions above the slits to be bent upwardly to install the ends of a sandpaper sheet. To further aid in securing the sandpaper sheet, the top surface of the end portions, below the slits have at least one nail-like retention protrusion. The disadvantage of this arrangement is that it is rather complex and thus costly to manufacture. Another shortcoming is that in order to load the sandpaper sheet, the user must bend upwardly the tops of the end portions in order to insert both ends of the sandpaper sheet. Then the user must immediately press down on the upper portions of the ends in order to ensure that the retention protrusions have punctured the ends of the sheet. This requires a combination of dexterity and some practice.

BRIEF SUMMARY OF THE INVENTION

In view of the foregoing disadvantages inherent in the sanding blocks of the prior art, what is needed is a new sanding block that introduces new and significant advantages and overcomes the drawbacks of presently available sanding blocks by attaining the following major objectives:

(a) A simple two-piece sanding block without any moving parts, prongs, bolts, screws, clamps or other hardware accessories or appurtenances, for use with sandpaper or other abrasive sheet material.

(b) A sanding block that can be easily and inexpensively manufactured, preferably all of one inexpensive material, such as wood, molded plastic, hard rubber or aluminum.

(c) A sanding block that is versatile and has both a generally flat sanding surface on one piece and a generally arcuate sanding surface on the other piece. Also, wherein both sanding surfaces can be used with the same typical size strip of sandpaper.

(d) A sanding block wherein the two pieces are held together with the ends of the sandpaper strip therebetween by friction and the wedging force of one piece impinging against the other piece, without requiring downward hand pressure by the user to retain the two pieces together while sanding and when not in use.

(e) A sanding block that is sized and shaped to fit comfortably in the user's hand and has appropriately shaped finger recesses on each side to provide a secure grip.

(f) A sanding block wherein the sandpaper strip can be easily and securely installed and easily removed without requiring any special effort or practice.

(g) A sanding block wherein the sandpaper strip is securely held in place during the sanding operation without shifting or wrinkling of the sandpaper, and wherein the two pieces of the sanding block are securely held together to preclude movement relative to one another during sanding.

(h) A sanding block that can be conveniently and efficiently packaged, displayed, and stored.

The present invention is a simple, convenient two-piece sanding tool for use with conventional sandpaper or other abrasive sheet material. The sanding tool consists of a rectangular base unit having a generally flat sanding surface, and a block unit having a generally arcuate sanding surface. The base unit has a rectangular floor and two end walls that slope outwardly at a small vertical angle designated as "angle B." The block unit is configured to fit tightly into the base unit, and has a generally arcuate sanding surface and an opposite flat surface. The two ends of the block unit also slope outwardly at a smaller angle designated as "angle A."

Either the flat base floor sanding surface or the arcuate block sanding surface can be selected and used as a sanding surface. In either arrangement, the end of the sandpaper strip is held securely in place between the block end surface and the end wall inner surface of the base unit. As the block unit is inserted and pressed into the base unit, the ends of the block unit are wedged tightly against the inner surface of the end walls of the base unit, with the ends of the sandpaper impinged therebetween. Because of the small difference in the vertical angle of the block end surface and the vertical angle of the end wall inner surface of the base unit, the sandpaper end is wedged increasingly tighter as the block unit is pressed further into the base unit between the end walls thereof. With the strong impingement force and the strong frictional force, the base unit, the block unit, and the sandpaper therebetween will remain securely in place until the user forcibly extracts the block unit from between the walls of the base unit.

These and other objects, features, aspects, and advantages of the invention will become better appreciated and more clearly understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit and scope thereof, and the embodiments of the invention are intended to include all such modifications.

DETAILED DESCRIPTION OF THE INVENTION

The examples used herein are intended merely to facilitate an understanding of the ways in which the embodiments of the invention may be practiced and to further enable those having skill in the art to practice the principles and concepts of the invention. Accordingly, the examples given should not be construed as limiting the scope of the invention.

Figure 1:
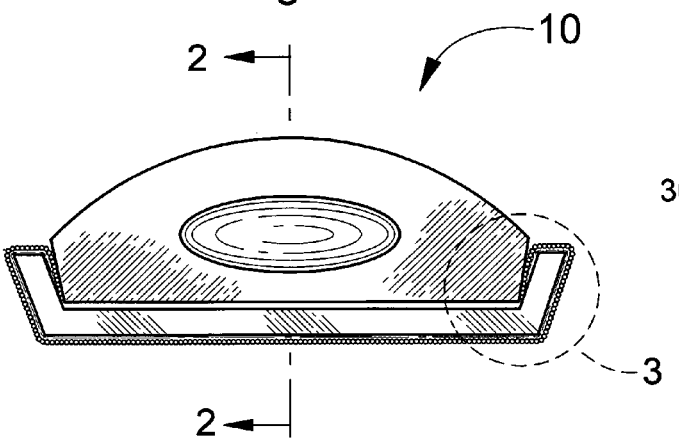
FIG. 1 is a side view of the sanding tool showing the sandpaper strip loaded on the generally flat sanding surface of the base unit.
Figure 2:
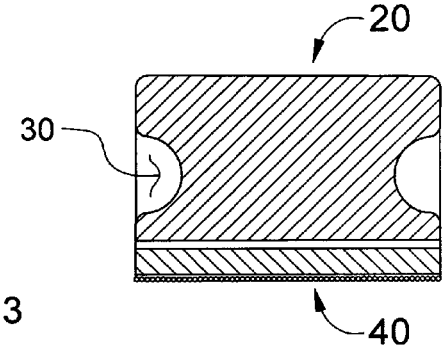
FIG. 2 is a vertical sectional view taken along line 2-2 in FIG. 1, again showing sandpaper loaded on the generally flat outer surface of the base unit.
Figure 3:
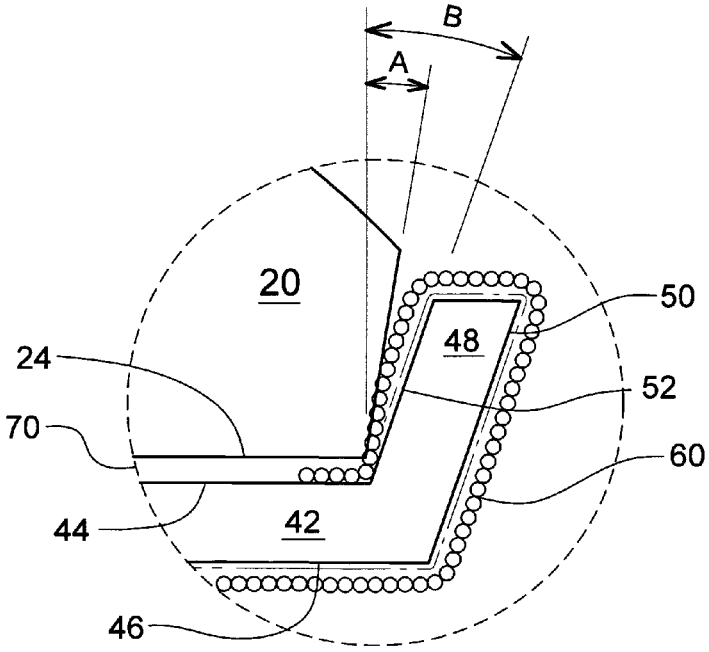
FIG. 3 illustrates detail 3 of FIG. 1 and shows the block unit pressed into the base unit, with the end of the sandpaper strip impinged securely between the block end surface and the inner wall surface of the base unit.
Figure 4:
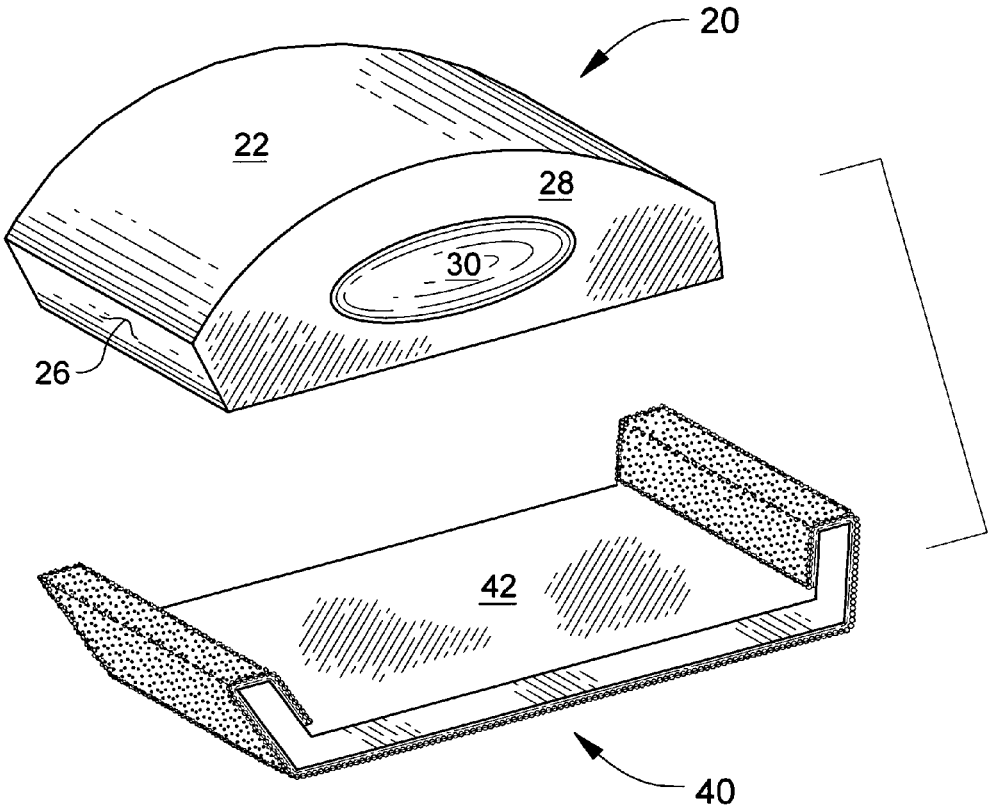
FIG. 4 is a perspective view of the sanding tool showing the sandpaper strip in place on the base unit ready for insertion of the block unit between the walls of the base unit.

Reference is now made to the drawings wherein like numerals designate like parts throughout. Reference is made first to FIG. 1 wherein the two-piece sanding tool 10 is shown. Sanding tool 10 comprises a block unit 20 that fits into and engages a base unit 40. Block unit 20 includes a generally arcuate block sanding surface 22, a block flat surface 24, two block end surfaces 26, two block sidewalls 28, and an ergonomically configured finger recess 30 disposed into each block sidewall 28. Block end surface 26 has a small outward slope designated as angle A as shown in FIG. 3. Block unit 20 has a generally rectangular horizontal cross-sectional configuration.

Base unit 40 also has a generally rectangular horizontal cross-sectional configuration and further comprises a flat base floor 42, having a base floor inner surface 44, a base floor sanding surface 46, and two base end walls 48, each having an end wall outer surface 50 and an end wall inner surface 52. End wall inner surface 52 has an outward slope designated as angle B as shown in FIG. 3. Angle B is typically approximately 15 degrees. Block end surfaces 26 and end wall inner surfaces 52 can be roughened to provide added friction when the ends of a sandpaper strip 60 are placed therebetween. The two-piece sanding tool 10 is approximately 5½ inches long and approximately 2½ inches wide to fit comfortably in the user's hand and to accommodate a commonly available sandpaper strip 60 of 3⅔ inches by 9 inches. Block unit 20 and base unit 40 are preferably made of inexpensive material, such as molded plastic, wood, hard rubber, aluminum, or other suitable material, and they can be hollow or partially hollow.

Figure 5:
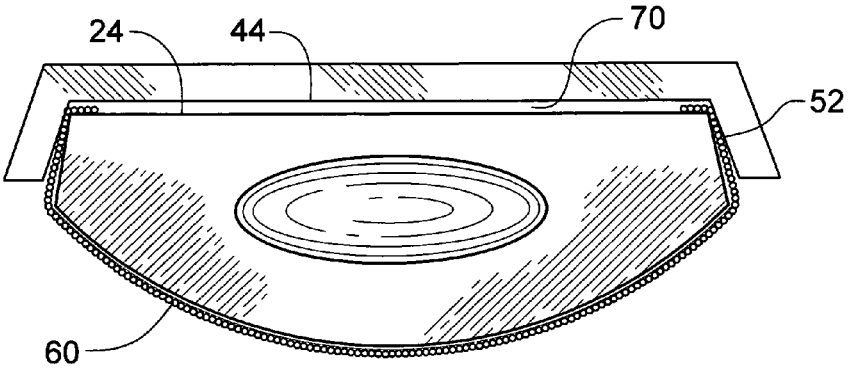
FIG. 5 is a side view of the sanding tool similar to FIG. 1, but with the sandpaper strip loaded on the generally arcuate block sanding surface of the block unit.

As shown on FIGS. 1-4, the sandpaper strip 60 can be placed on base floor sanding surface 46 and end wall outer surfaces 50. Alternatively, the sandpaper strip 60 can be applied to block sanding surface 22 and block end surfaces 26 as illustrated in FIG. 5. In either arrangement, the ends of the sandpaper strip 60 are wedged tightly between block end surface 26 and end wall inner surface 52 of base unit 40 when block unit 20 is firmly pressed into base unit 40. Because of the difference in the slope angles of block end surface 26 and end wall inner surface 52, and block flat surface 24 being nearly as long as base floor inner surface 44, there can be a small gap 70 of approximately 3/32 of an inch remaining between block flat surface 24 and base floor inner surface 44 after block unit 20 is pressed firmly into base unit 40. With block unit 20, sandpaper strip 60, and base unit 40 impinged tightly together, sandpaper strip 60 will remain securely in place without slippage, and block unit 20 and base unit 40 will remain tightly together without requiring the user's hand pressure to hold them together. The impingement angle B is typically approximately 15 degrees but can vary by approximately plus or minus 5 degrees. A wider angle allows easier assembly of the components, while a narrower angle provides somewhat tighter impingement of the components. Angle A on the block end surface 26 is typically approximately 5 degrees.

The major advantages of this invention are:

(a) The sanding tool of the present invention is an extremely simple two-piece sanding block that does not require any moving parts, prongs, bolts, screws, clamps or other hardware accessories or appurtenances for use with sandpaper or other abrasive sheet material.

(b) It can be easily and inexpensively manufactures of wood, molded plastic, hard rubber, aluminum or other suitable material.

(c) This sanding block is versatile and has both a generally flat sanding surface on one piece and a generally arcuate sanding surface on the other piece.

(d) This sanding block enables the two pieces to be held securely together with the ends of the sandpaper strip therebetween by friction and the wedging force of one piece impinging against the other piece, without requiring downward hand pressure by the user to retain the two pieces together while sanding and when not in use.

(e) It is sized and shaped to fit comfortably in the user's hand and has appropriately shaped finger recesses on each side to provide a secure grip.

(f) The sanding block allows easy and secure installation of the sandpaper strip and easy removal without requiring any special effort or practice.

(g) It provides for the sandpaper strip to be securely held in place during the sanding operation without shifting or wrinkling of the sandpaper, and wherein the two pieces of the sanding block are securely held together to preclude movement relative to one another during sanding.

(h) This sanding block is configured to be conveniently and efficiently packaged, displayed, and stored.

METHOD OF USE

The user can install the sandpaper strip 60 on either the base unit 40 or the block unit 20. To install the sandpaper strip

60 on the base unit 40, base unit 40 is centered upon the back side of the sandpaper strip 60. Then the two ends of the sandpaper strip 60 are bent upwardly along the end wall outer surfaces 50, and then downwardly along the end wall inner surfaces 52 as shown in FIGS. 1-4. Then the user firmly presses block unit 20 into base unit 40 to wedge sandpaper strip 60 tightly between block end surface 26 and end wall inner surface 52 of base unit 40 as detailed in FIG. 3. By pressing block unit 20 firmly into base unit 40, sandpaper strip 60 will be securely impinged therebetween, and the components will remain tightly wedged together due to the compressive impingement force and the frictional force of the adjacent surfaces of block unit 20, sandpaper strip 60 and base unit 40, without requiring any hand pressure by the user.

In a similar manner, the sandpaper strip 60 can be used on the block sanding surface 22 by installing the sandpaper strip 60 on block sanding surface 22 and block end surfaces 26 as shown in FIG. 5. When the user chooses to remove the sandpaper strip 60, he/she grips the block unit 20 with one hand and the base unit 40 with the other hand and firmly pulls them apart to access and remove the sandpaper strip 60.

CONCLUSION

It should be understood that the phraseology or terminology employed herein is for purposes of description and not of limitation. The above description is considered that of the preferred embodiments only. While these embodiments of the invention have been shown on the drawings and described herein, it is to be understood that they are merely for illustrative purposes only and not intended to limit the scope of the invention. Workers skilled in the art will recognize additions, deletions, and other modifications that can be made in form and detail without departing from the spirit and scope of the invention. Thus, the scope of the invention should be determined by the appended claims, and not by the specific examples given.

The invention claimed is:

1. A two-piece sanding tool for holding a sandpaper strip or other abrasive sheet material comprising a separate unitary block unit and a separate unitary base unit, said block unit further comprising a generally arcuate block sanding surface, a block flat surface, two block end surfaces, two block sidewalls, and a finger recess in each said block sidewall, said base unit further comprising a base floor, a base floor inner surface, a base floor sanding surface, two base end walls, two end wall outer surfaces, and two end wall inner surfaces, said block end surfaces each having a predetermined outward vertical slope angle A, whereas said end wall inner surfaces of said base unit each having an outward vertical slope angle B that is larger than said angle A, wherein said sandpaper strip is placed over either said block sanding surface or over said base floor sanding surface with each end of said sandpaper strip positioned between said block end surface and said end wall inner surface with the end of said sandpaper strip extending at least to said base floor inner surface of said base unit, such that when said block unit is firmly pressed into said base unit, said block end surface will converge with said end wall inner surface, and the end of said sandpaper strip will be securely impinged between the converged said block end surface and said end wall inner surface, and the ends of said sandpaper strip will remain securely wedged in place due to the impingement force and the frictional forces of said block end surface, said sandpaper strip, and said end wall inner surface, until the user chooses to remove said sandpaper strip by firmly separating said block unit from said base unit to access and remove said sandpaper strip.

2. The sanding tool of claim 1 further wherein said angle A is 5 degrees and wherein said angle B is 15 degrees.

3. The sanding tool of claim 2 further wherein said block unit and said base unit are substantially hollow.

4. The sanding tool of claim 3 further wherein said block end surfaces and said end wall inner surfaces are roughened to provide added friction with said sandpaper strip.

5. The sanding tool of claim 3 further wherein said block unit sanding surface is at least partially arcuate and wherein said base unit sanding surface is at least partially flat.

6. The sanding tool of claim 2 further wherein said block end surfaces and said end wall inner surfaces are roughened to provide added friction with said sandpaper strip.

7. The sanding tool of claim 6 further wherein said block unit sanding surface is at least partially arcuate and wherein said base unit sanding surface is at least partially flat.

8. The sanding tool of claim 2 further wherein said block unit sanding surface is at least partially arcuate and wherein said base unit sanding surface is at least partially flat.

9. The sanding tool of claim 1 further wherein said block unit and said base unit are substantially hollow.

10. The sanding tool of claim 9 further wherein said block end surfaces and said end wall inner surfaces are roughened to provide added friction with said sandpaper strip.

11. The sanding tool of claim 10 further wherein said block unit sanding surface is at least partially arcuate and wherein said base unit sanding surface is at least partially flat.

12. The sanding tool of claim 9 further wherein said block unit sanding surface is at least partially arcuate and wherein said base unit sanding surface is at least partially flat.

13. The sanding tool of claim 1 further wherein said block end surfaces and said end wall inner surfaces are roughened to provide added friction with said sandpaper strip.

14. The sanding tool of claim 13 further wherein said block unit sanding surface is at least partially arcuate and wherein said base unit sanding surface is at least partially flat.

15. The sanding tool of claim 1 further wherein said block unit sanding surface is at least partially arcuate and wherein said base unit sanding surface is at least partially flat.

* * * * *